US010005536B2

(12) United States Patent
Fukuchi et al.

(10) Patent No.: US 10,005,536 B2
(45) Date of Patent: Jun. 26, 2018

(54) OUTBOARD MOTOR

(71) Applicant: SUZUKI MOTOR CORPORATION, Hamamatsu-Shi, Shizuoka (JP)

(72) Inventors: Satoru Fukuchi, Hamamatsu (JP); Keisuke Daikoku, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days. days.

(21) Appl. No.: 15/606,823

(22) Filed: May 26, 2017

(65) Prior Publication Data

US 2017/0341723 A1 Nov. 30, 2017

(30) Foreign Application Priority Data

May 30, 2016 (JP) ..... 2016-107708

(51) Int. Cl.

| | |
|---|---|
| ***B63H 21/30*** | (2006.01) |
| ***F02B 61/04*** | (2006.01) |
| ***F02B 75/00*** | (2006.01) |
| *B63H 20/10* | (2006.01) |
| *B63H 20/24* | (2006.01) |
| *B63H 20/28* | (2006.01) |
| *F02B 75/02* | (2006.01) |

(52) U.S. Cl.

CPC ..... *B63H 21/305* (2013.01); *F02B 61/045* (2013.01); *F02B 75/007* (2013.01); *B63H 20/10* (2013.01); *B63H 20/24* (2013.01); *B63H 20/28* (2013.01); *F02B 2075/027* (2013.01)

(58) Field of Classification Search

CPC ..... B63H 21/30; B63H 21/302; B63H 21/305

See application file for complete search history.

(56) References Cited

U.S. PATENT DOCUMENTS

| | | | | |
|---|---|---|---|---|
| 5,309,782 | A | 5/1994 | Seaman | |
| 6,645,019 | B1 * | 11/2003 | Shiomi | B63H 20/02 440/52 |
| 7,896,304 | B1 * | 3/2011 | Eichinger | B63H 20/12 248/440 |
| 9,643,703 | B1 * | 5/2017 | Eichinger | B63H 20/02 |
| 2017/0314461 | A1 * | 11/2017 | Mizutani | F02B 61/045 |

FOREIGN PATENT DOCUMENTS

| | | | |
|---|---|---|---|
| JP | 06221382 | A | 8/1994 |

* cited by examiner

*Primary Examiner* — Andrew Polay
(74) *Attorney, Agent, or Firm* — Troutman Sanders LLP

(57) ABSTRACT

Upper anti-vibration mounts have axial lines arranged in parallel to a longitudinal center line extending in a longitudinal direction of the outboard motor body. Lower anti-vibration mounts have axial lines concentrated on one point on the longitudinal center line extending in a longitudinal direction of the outboard motor body. Meanwhile, the axial lines are inclined at the identical angle symmetrically with respect to the longitudinal center line, so that they intersect in a V-shape in front of the support shaft as seen in a plan view of the outboard motor body.

4 Claims, 10 Drawing Sheets

WORKING MOUNTS DEPENDING ON OPERATION STATE

| | | | FORWARD OPERATION | | | NEUTRAL | BACKWARD OPERATION | |
|---|---|---|---|---|---|---|---|---|
| | | | HIGH-SPEED | MIDDLE-SPEED | LOW-SPEED | NO TRAVEL | LOW-SPEED | MIDDLE-SPEED |
| MOUNTS | UPPER | MAIN (SOFT) | — | WORKS | WORKS | WORKS | WORKS | WORKS |
| | | SUBSIDIARY (HARD) | WORKS | — | — | — | — | — |
| | LOWER | MAIN (SOFT) | — | — | WORKS | WORKS | WORKS | — |
| | | SUBSIDIARY (HARD) | WORKS | WORKS | — | — | — | WORKS |

FIG. 11

MOUNT ARRANGEMENT IN OUTBOARD MOTOR AND ANTIVIBRATION/SUSPENSION PERFORMANCE

| MOUNT ARRANGEMENT | | | | | | | | | | |
|---|---|---|---|---|---|---|---|---|---|---|
| | | | UPPER | PARALLEL | | PARALLEL | | V-SHAPE | | V-SHAPE | |
| | | | LOWER | PARALLEL | | V-SHAPE | | PARALLEL | | V-SHAPE | |
| | | | OUTBOARD MOTOR | SMALL-SIZED | LARGE-SIZED | SMALL-SIZED | LARGE-SIZED | SMALL-SIZED | LARGE-SIZED | SMALL-SIZED | LARGE-SIZED |
| ANTI-VIBRATION PERFORMANCE | ENGINE | VERTICAL | | △ | ○ | △ | ○ | ○ | △ | ○ | △ |
| | | HORIZONTAL | | △ | ○ | △ | ○ | ○ | △ | ○ | △ |
| | | ROTATION (VARIATION OF TORQUE) | | △ | ○ | △ | ○ | ○ | △ | ○ | △ |
| | VARIATION OF THRUST FORCE | | | △ | △ | ○ | ○ | △ | ○ | △ | ○ |
| SUSPENSION PERFORMANCE | PROPELLER THRUST FORCE | | | △ | × | ○ | ○ | △ | × | ○ | ○ |
| | HORIZONTAL FORCE (RUDDER LIFTING FORCE) | | | △ | × | ○ | ○ | △ | × | ○ | ○ |

OUTBOARD MOTOR

CROSS-REFERENCE TO RELATED APPLICATIONS

This application is based upon and claims the benefit of priority of the prior Japanese Patent Application No. 2016-107708, filed on May 30, 2016, the entire contents of which are incorporated herein by reference.

BACKGROUND OF THE INVENTION

Field of the Invention

The present invention relates to an outboard motor supported and mounted to a ship hull by interposing a suspension unit.

Description of the Related Art

Typically, an outboard motor has an anti-vibration structure installed with an anti-vibration member or the like in order to prevent an engine vibration from propagating to a ship hull.

In the prior art, an outboard motor is discussed, for example, in Patent Document 1, in which anti-vibration mounts obtained by interposing a shock-absorbing material between facing holders are arranged obliquely and symmetrically with respect to a center line of the outboard motor body.

Patent Document 1: Japanese Laid-open Patent Publication No. 6-221382

Since the anti-vibration mount receives a propeller thrust force and a steering reaction force, a mount bracket for supporting the anti-vibration mount necessitates high strength and rigidity. In addition, the arrangement (such as orientation) of the anti-vibration mounts affects assemblability. In the outboard motor of the prior art, the size of the mount bracket used to install the anti-vibration mount tends to increase. If the size of the mount bracket is reduced, assemblability is degraded. This makes it difficult to improve workability and cost efficiency.

SUMMARY OF THE INVENTION

In view of the aforementioned problems, it is therefore an object of the present invention to provide an outboard motor capable of effectively reducing size and cost.

According to an aspect of the present invention, there is provided an outboard motor including: a clamp bracket fixedly installed in a rear part of a ship hull; a swivel bracket provided with a support shaft extending in a vertical direction and supported by the clamp bracket; an outboard motor body installed in the swivel bracket swingably with respect to the support shaft; a pair of left and right anti-vibration mounts provided with an outer tube interposed between the swivel bracket and the outboard motor body, an inner tube loosely fitted to the outer tube, and a shock-absorbing material interposed between the outer and inner tubes. The pair of left and right anti-vibration mounts are each arranged in an upper part of the swivel bracket over the clamp bracket and a transom board of the ship hull and in a lower part of the swivel bracket vertically overlapping with the transom board of the ship hull under the clamp bracket, the upper pair of left and right anti-vibration mounts have axial lines arranged in parallel with a longitudinal center line extending in a longitudinal direction of the outboard motor body, the lower pair of left and right anti-vibration mounts have axial lines concentrated on one point on the longitudinal center line extending in the longitudinal direction of the outboard motor body and inclined at an identical angle symmetrically with respect to the longitudinal center line, such that the axial lines intersect in a V-shape in front of the support shaft as seen in a plan view of the outboard motor body.

BRIEF DESCRIPTION OF THE DRAWINGS

FIG. 11 is a diagram illustrating a result of evaluation for a relationship between the mount arrangement and the performance of the outboard motor depending on an outboard motor type according to an embodiment of the invention.

DETAILED DESCRIPTION OF THE PREFERRED EMBODIMENTS

A description will now be made for an embodiment of the present invention with reference to the accompanying drawings. The embodiment of the present invention typically relates to an outboard motor having contra-rotating propellers. Note that, in each drawing, arrows will be appropriately used to indicate front, rear, left, right, upper, and lower directions.

Figure 1:
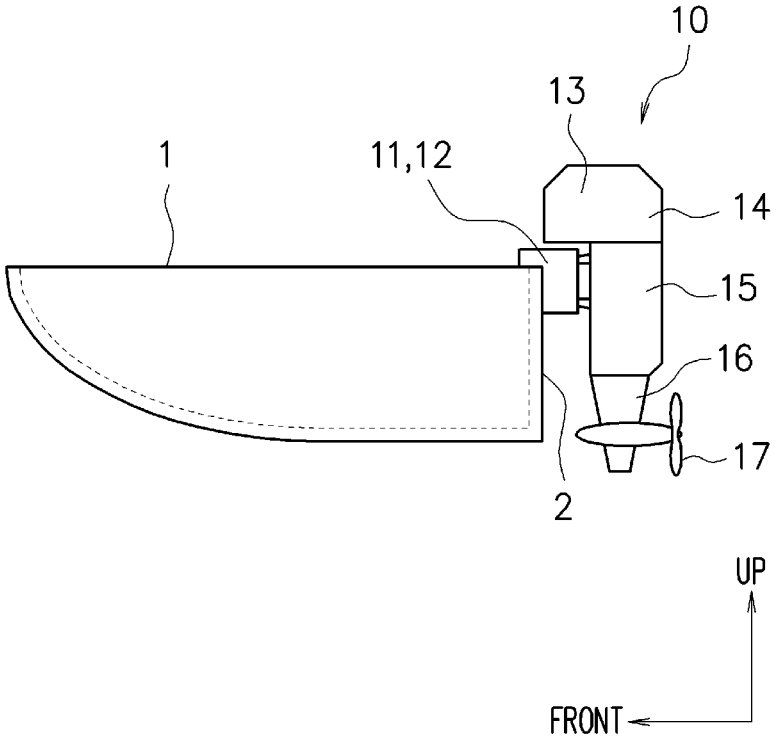
FIG. 1 is a left side view schematically illustrating an outboard motor mounted to a ship hull according to an embodiment of the invention.

Referring to FIG. 1, an outboard motor 10 is mounted to a transom board 2 in a rear end of a boat (ship hull) using a clamp bracket 11 and a swivel bracket 12.

Figure 2:
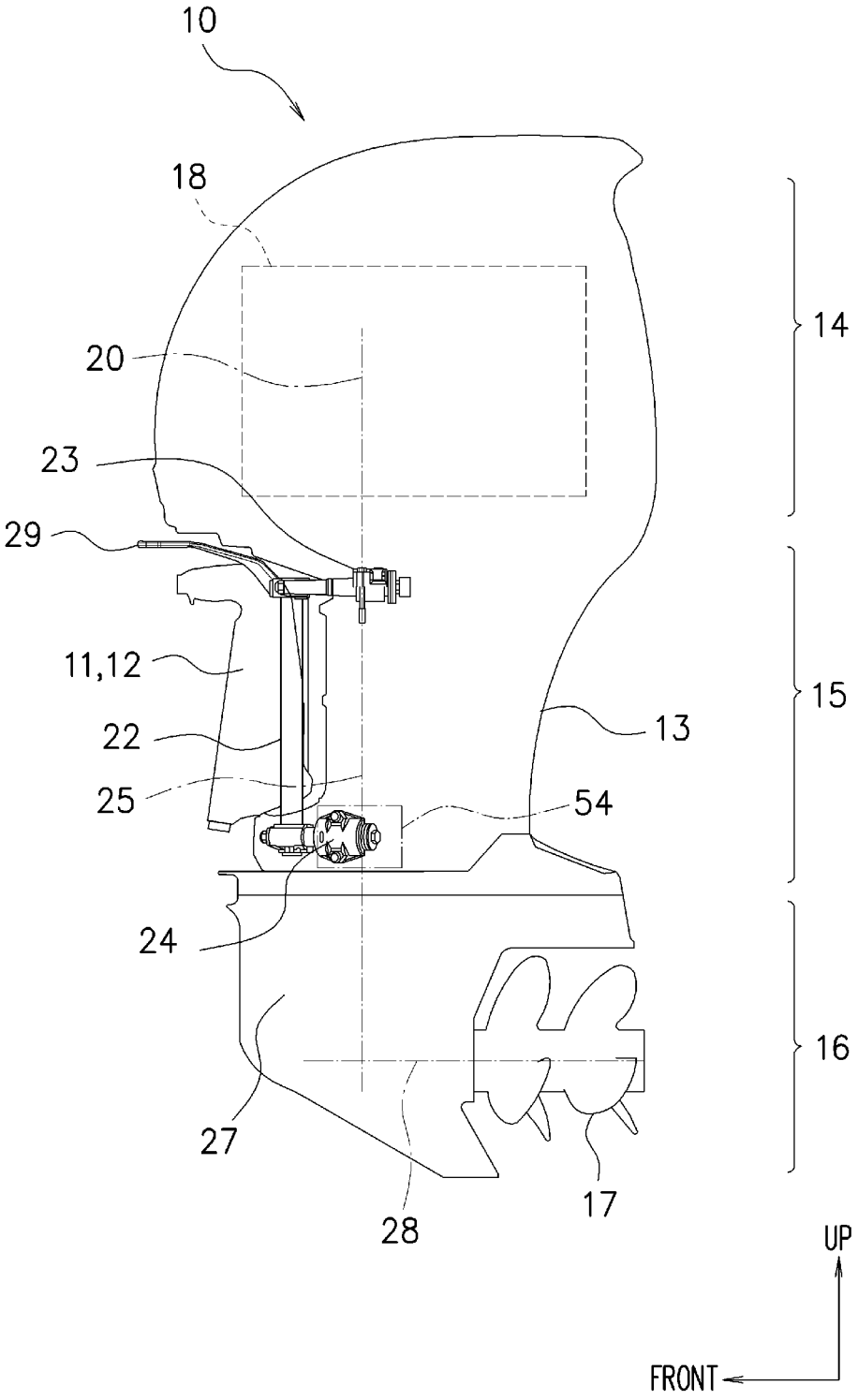
FIG. 2 is a left side view schematically illustrating an exemplary configuration of the entire outboard motor according to an embodiment of the invention.

As illustrated in FIG. 2, an outboard motor body has an engine unit 14, a middle unit 15, and a lower unit 16, so that the boat 1 is driven by a thrust force generated from a propeller 17 of the lower unit 16.

In the engine unit 14, an engine 18 is vertically mounted and supported to an engine holder 19 (refer to FIG. 3) of the middle unit 15 such that its crankshaft 20 is aligned in a vertical direction. In this example, the engine 18 is, for example, a V-type four-cycle multi-cylinder engine provided with a left bank extending to the left side with a backward inclination and a right bank extending to the right side with a backward inclination. Note that other types of engines such as an in-line multi-cylinder engine may also be employed. Although not shown in the drawings, in each bank, a cylinder block, a cylinder head, and a cylinder head cover are sequentially assembled to the crankcase that supports the crankshaft 20 to form a reciprocal engine. Therefore, an explosion force and an inertial force are generated in a cylinder axis direction.

Figure 3:
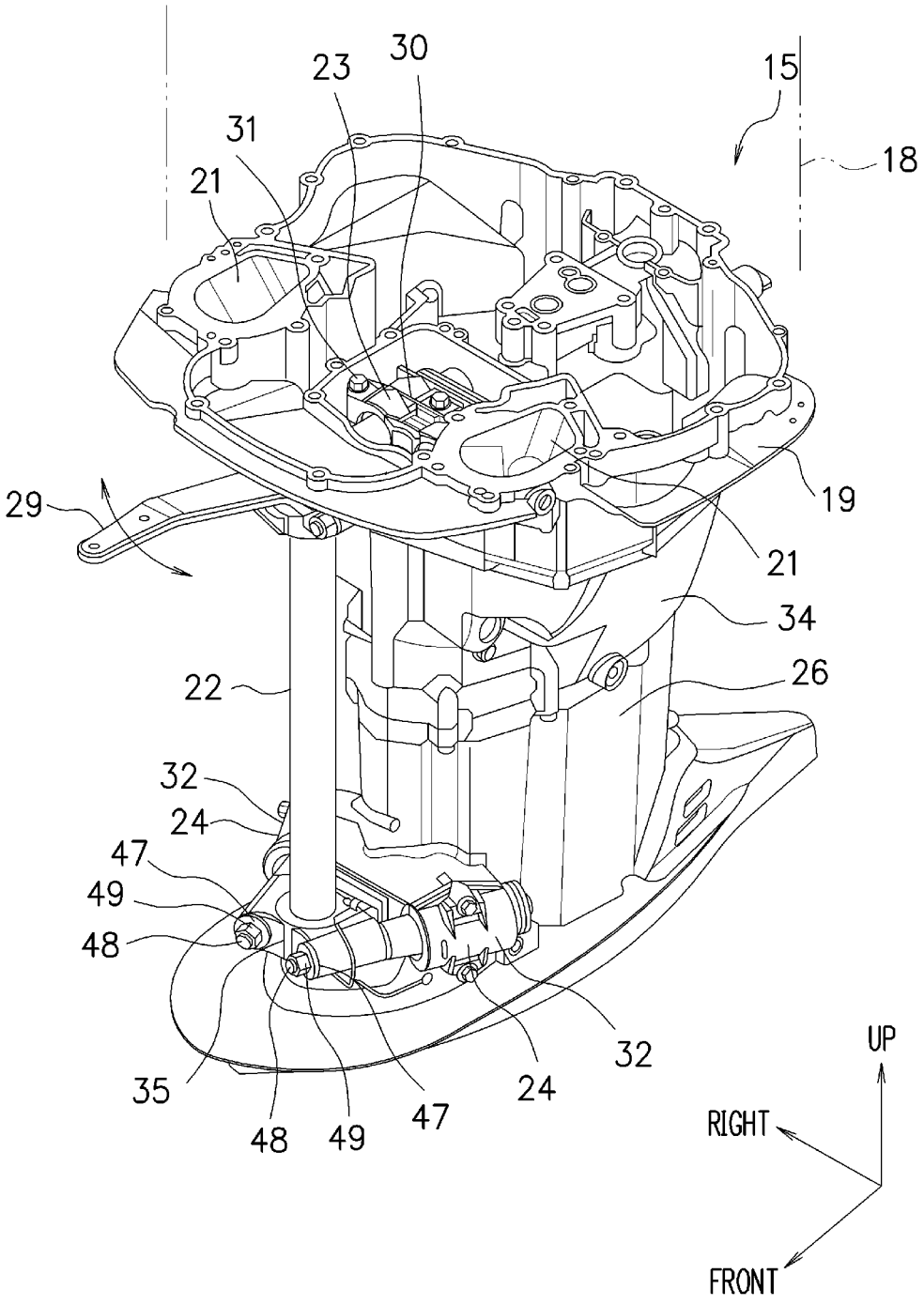
FIG. 3 is a perspective view illustrating an exemplary middle unit of the outboard motor according to an embodiment of the invention.

Exhaust passages communicate with combustion chambers of the left and right banks of the engine 18. Each exhaust passage communicates with an exhaust passages 21 provided inside the middle unit 15 through the outer sides of the left and right banks in the width direction of the outboard motor as illustrated in FIG. 3. The exhaust passages 21 of the middle unit 15 extend downward and communicate with exhaust passages in the lower unit 16. An exhaust gas generated from the engine 18 passes through the exhaust passages 21 from the exhaust passages of each bank and is discharged to the seawater from the exhaust passages of the lower unit 16.

Figure 4:
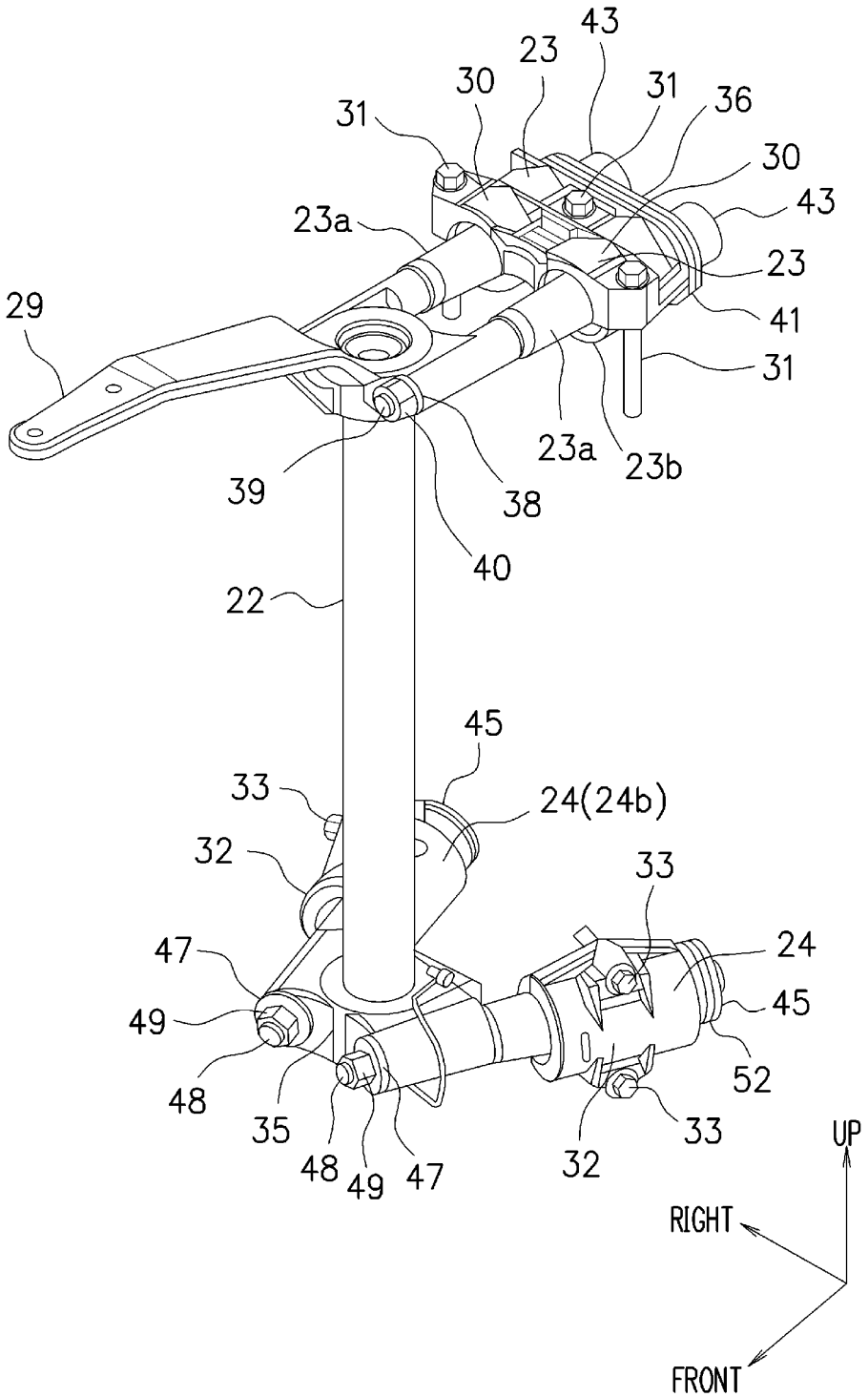
FIG. 4 is a perspective view illustrating an exemplary configuration of components around a steering shaft and a swivel bracket of the outboard motor according to an embodiment of the invention.
Figure 5:
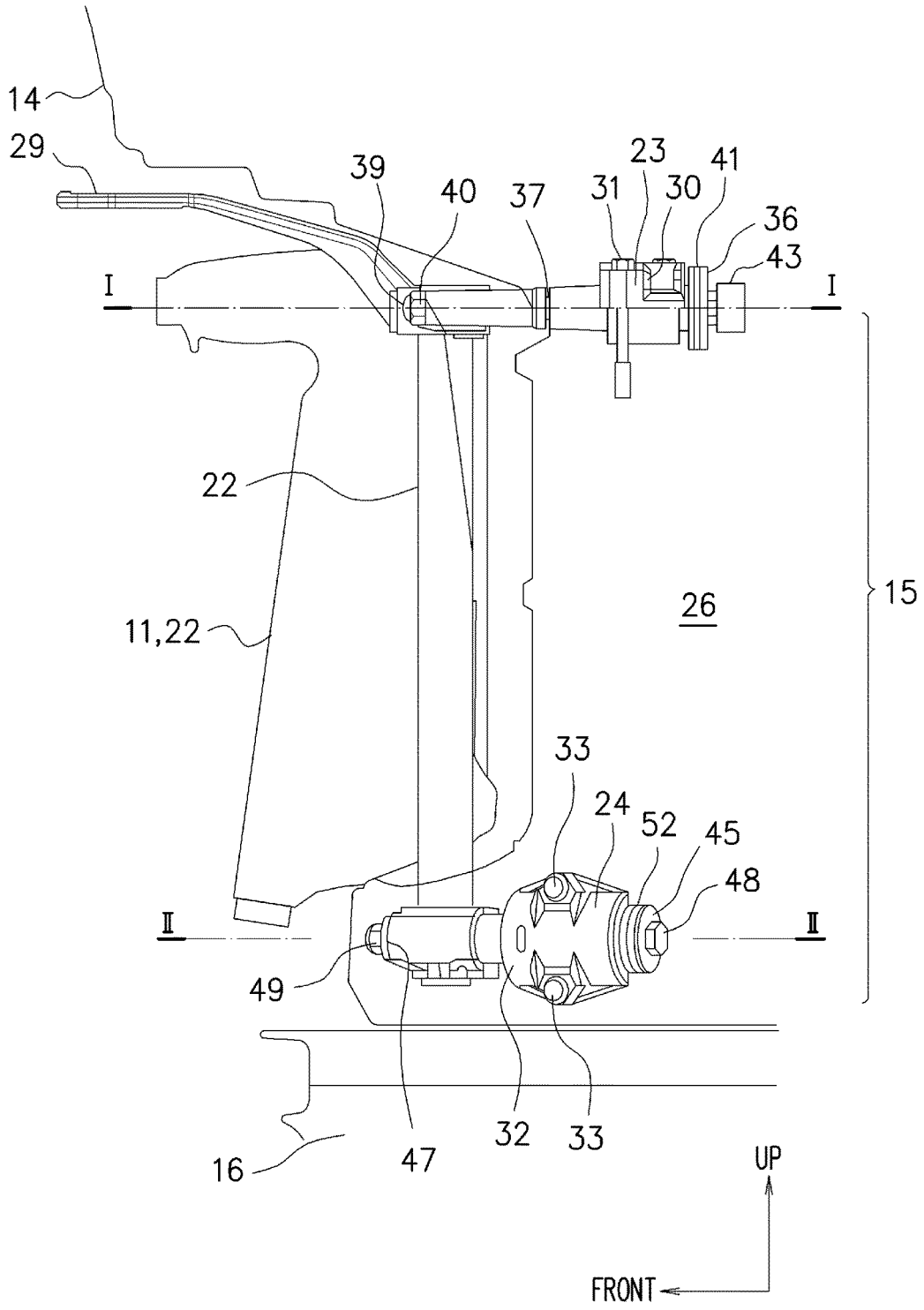
FIG. 5 is a side view illustrating an exemplary configuration of components around the steering shaft and the swivel bracket of the outboard motor according to an embodiment of the invention.

In the middle unit 15, the steering shaft 22 is supported by the swivel bracket 12 pivotably in the horizontal direction. As illustrated in FIGS. 4 and 5, the upper mounts 23 are arranged to match the upper end of the steering shaft 22, and the lower mounts 24 are arranged to match the lower end of the steering shaft 22. Here, a drive shaft 25 connected to the lower end of the crankshaft 20 of the engine is arranged to vertically penetrate through the middle unit 15 as illustrated in FIG. 2. The drive shaft 25 is housed in the drive shaft housing 26 as illustrated in FIG. 3, and a driving force of the drive shaft 25 is transmitted to the propeller shaft 28 disposed inside a gear casing 27 of the lower unit 16.

The outboard motor body 13 is integrally pivotably supported by the steering shaft 22 by installing the upper and lower mounts 23 and 24. By virtue of a pivot operation of the steering bracket 29 sticking to the upper end of the steering shaft 22, the outboard motor 10 is steered.

In this case, the upper and lower mounts 23 and internally have an anti-vibration rubber as described below. Therefore, it is possible to alleviate an engine vibration generated from the engine 18 of the outboard motor 10, a variation of the propeller thrust force, or a variation of a rudder force (lifting force) and prevent them from directly propagating to the ship hull.

The upper mount 23 is disposed in an upper part of the clamp bracket 11 and the swivel bracket 12 over the transom board 2 of the ship hull. In addition, the lower mount 24 is disposed in a lower part of the swivel bracket 12 vertically overlapping with the transom board 2 of the ship hull under the clamp bracket 11.

In this case, axial lines L1 (refer to FIG. 6) of the upper mount 23 are arranged in parallel with a longitudinal center line extending in a longitudinal direction of the outboard motor body 13, and axial lines L2 (refer to FIG. 7) of the lower mount 24 are concentrated on one point on the longitudinal center line extending in the longitudinal direction of the outboard motor body 13. Since the axial lines of the lower mounts 24 are inclined at the identical angle symmetrically with respect to the longitudinal center line, the axial lines intersect in a V-shape in front of the steering shaft 22 serving as a support shaft as seen in a plan view of the outboard motor body 13.

Figure 6:
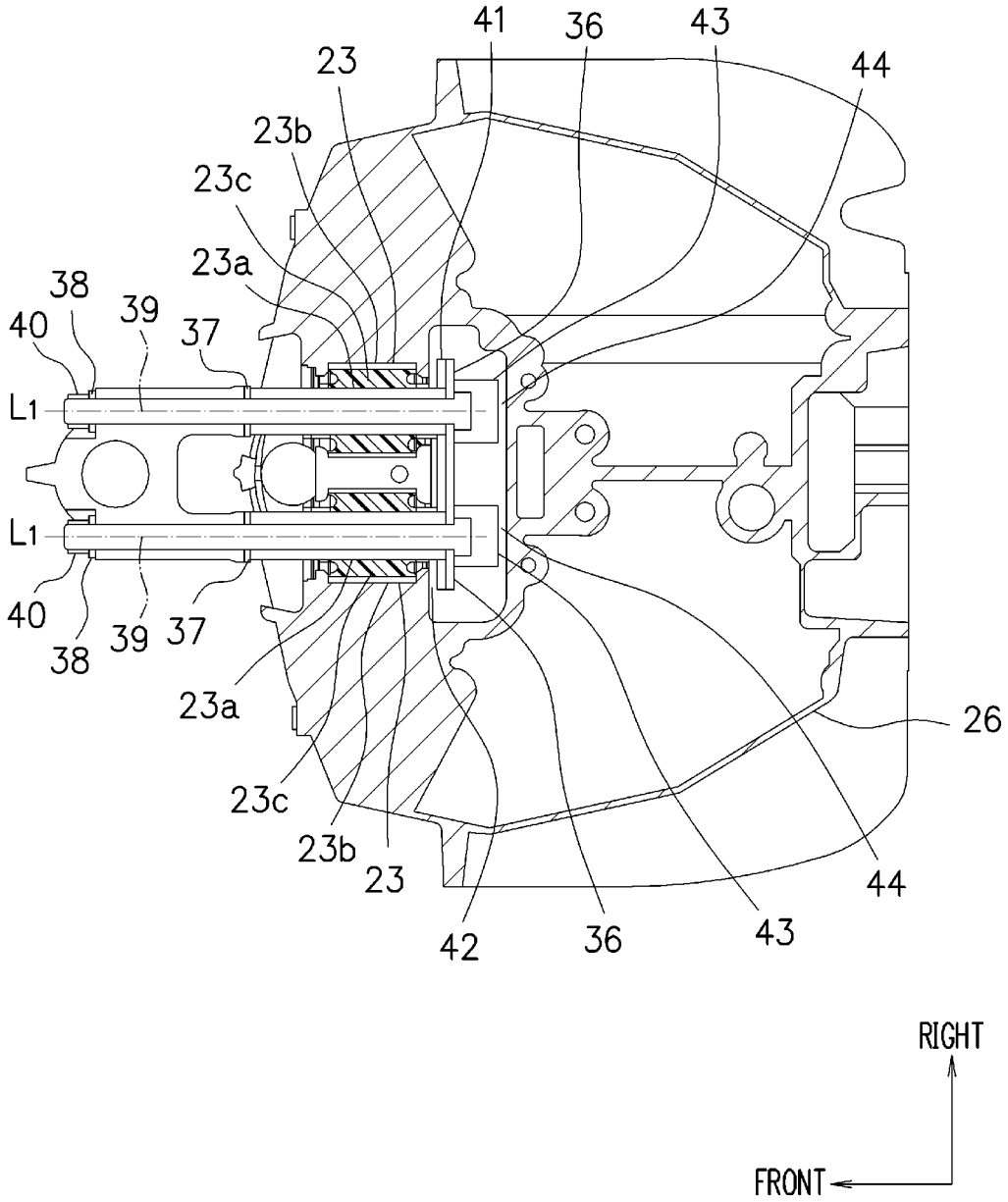
FIG. 6 is a cross-sectional view taken along a line I-I of FIG. 5 to illustrate an exemplary structure of an anti-vibration mount according to an embodiment of the invention.
Figure 7:
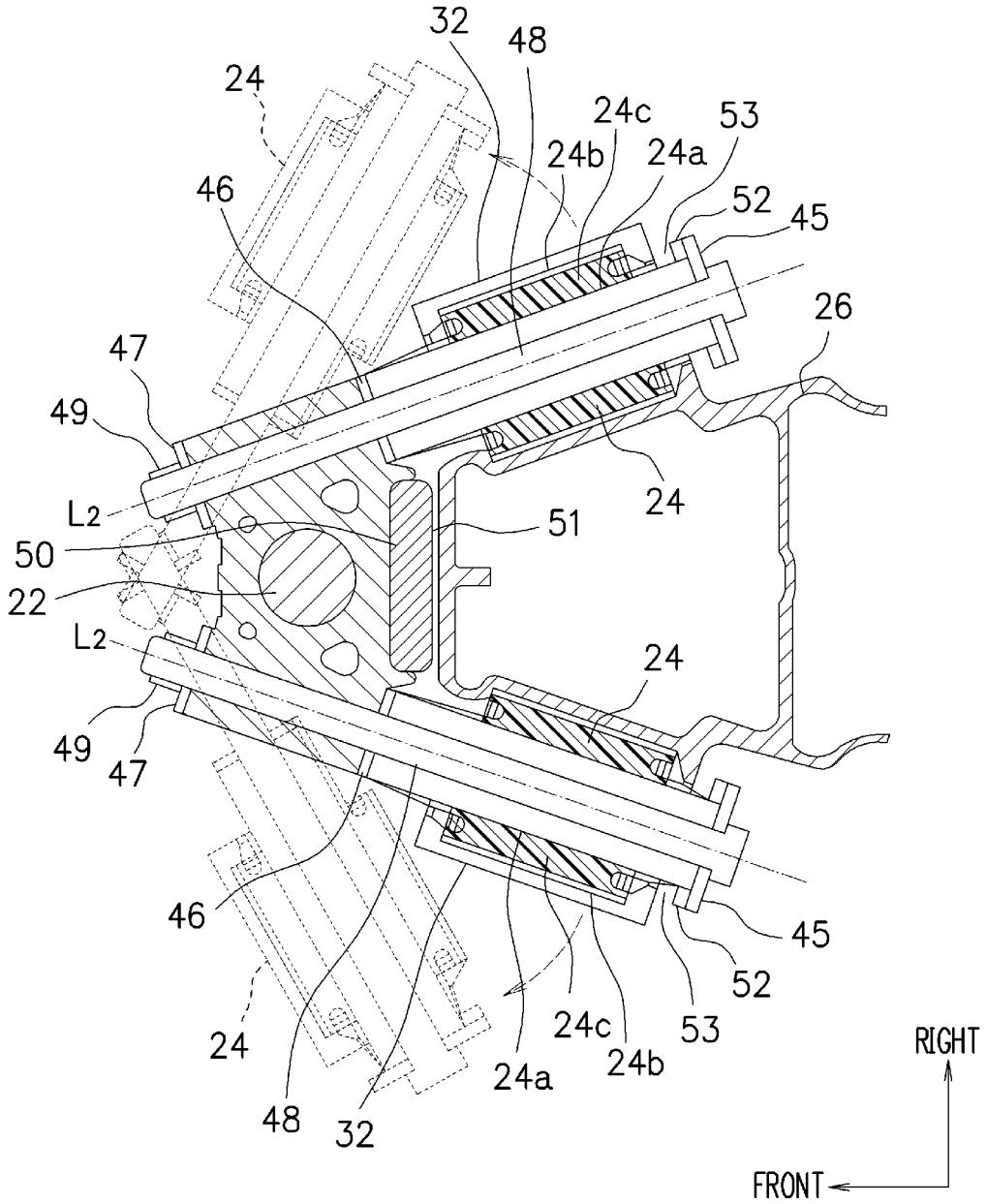
FIG. 7 is a cross-sectional view taken along a line II-II of FIG. 5 to illustrate an exemplary structure of the anti-vibration mount according to an embodiment of the invention.

As a specific mount structure, the upper and lower mounts 23 and 24 have a cylindrical shape. Referring to FIG. 6, in the case of the upper mount 23, the anti-vibration rubber 23*c* is vulcanized between the inner metal tube 23*a* and the outer metal tube 23*b*. As an external force is applied to the upper mount 23, the inner metal tube 23*a* and the outer metal tube 23*b* are displaced in an axial direction and perpendicularly to the axial direction depending on rubber hardness (spring constant) of the anti-vibration rubber 23*c*. The lower mount 24 also has a dual tube structure similar to that of the upper mount 23. Referring to FIG. 7, the lower mount has an inner metal tube 24*a*, an outer metal tube 24*b*, and an anti-vibration rubber 24*c*.

The upper mounts 23 (the outer metal tube 23*b*) are inserted into a pair of lower semi-cylindrical concave portions provided in the engine holder 19 (FIG. 3) in parallel with each other and are covered by upper mount covers 30 having a pair of upper semi-cylindrical concave portions as illustrated in FIG. 4. In this state, the upper mounts 23 are fastened with a plurality of bolts 31. As a result, the outer metal tubes 23*b* of the upper mounts 23 are interposed between the upper and lower semi-cylindrical concave portions and are fixed to the engine holder 19.

The lower mounts 24 (the outer metal tube 24*b*) are inserted into a pair of inner semi-cylindrical concave portions arranged in a V-shape narrowed to the front side of the drive shaft housing 26 (FIG. 3) and are covered by lower mount covers 32 having a pair of outer semi-cylindrical concave portions as illustrated in FIG. 4. In this state, the lower mounts 24 are fastened with bolts 33. As a result, the outer metal tubes 24*b* of the lower mounts 24 are interposed between the left and right semi-cylindrical concave portions and are fixed to the drive shaft housing 26.

The engine holder 19 and the drive shaft housing are combined with each other using bolts by interposing an oil pan 34 as illustrated in FIG. 3. In addition, the engine holder 19 is combined with the engine 18 using bolts. The drive shaft housing is combined with the lower unit 16 using bolts. Therefore, the outer metal tubes 23*b* of the upper mounts 23 and the outer metal tubes 24*b* of the lower mounts 24 are fixed to the outboard motor body 13.

The steering bracket 29 is formed integrally with the steering shaft 22. The steering shaft 22 is splined to the lower mount bracket 35, and both the steering shaft 22 and the lower mount bracket 35 can be steered integrally with respect to the clamp bracket 11 and the swivel bracket 12 (swingable in a yawing direction).

Referring to FIG. 6, the inner metal tubes 23*a* of the upper mounts 23 are fastened and fixed to the steering bracket 29 using bolts 39 and nuts 40 through a forward-side stopper receptacle 36, a spacer 37, and a washer 38.

In front of the forward-side stopper receptacles of the upper mounts 23, washer-like forward-side stoppers 41 formed of an anti-vibration rubber material are arranged. In addition, in front of the forward-side stoppers 41, clearances 42 are provided between the forward-side stoppers 41 and the engine holder 19. In the heads of the bolts 39, cap-like backward-side stoppers 43 formed of an anti-vibration rubber material are installed with clearances 44 from the engine holder 19.

Referring to FIG. 7, the lower mount 24 has an inner metal tube 24*a*, an outer metal tube 24*b*, and an anti-vibration rubber 24*c*. The inner metal tube 24*a* is fastened to the lower mount bracket 35 (FIG. 4) through a backward-side stopper receptacle 45, a spacer 46, and a washer 47 by using the bolts 48 and nuts 49.

A forward-side stopper 50 of the lower mount 24 is installed in the lower mount bracket 35 between the lower mount bracket 35 and the drive shaft housing 26 in the vicinity of the center of the left and right lower mounts 24. A clearance 51 is provided between the drive shaft housing 26 and the forward-side stopper 50 of the lower mounts 24.

A washer-like backward-side stopper 52 formed of an anti-vibration rubber is provided between the backward-side stopper receptacle 45 of the lower mount 24, the drive shaft housing 26, and the lower mount cover 32 in the lower mount 24. Clearances 53 are provided between the backward-side stoppers 52 of the lower mounts 24, the drive shaft housing 26, and the lower mount cover 32.

In this case, the middle unit 15 has a coupling portion coupled to the lower unit 16 in its lower end. Specifically, the drive shaft housing 26 is coupled to the lower unit 16 using bolts. A coolant pump 54 driven by the drive shaft 25 is provided in the vicinity of the coupling portion between the middle and lower units 15 and 16 as schematically illustrated in FIG. 2. The lower mount 24 serving as a lower anti-vibration mount has an axial line positioned to overlap with the coolant pump 54 as seen in the side view of the outboard motor body 13 in the lower end of the middle unit 15.

Figure 8:
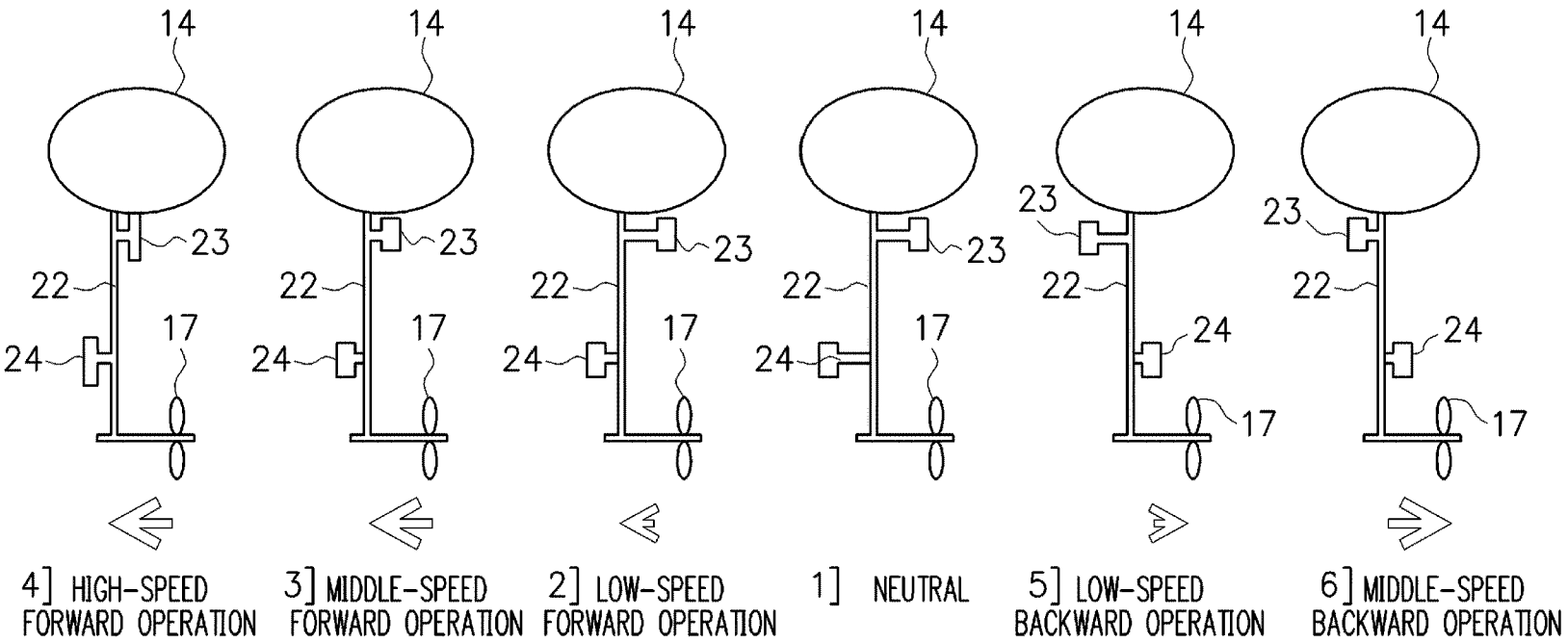
FIG. 8 is a diagram schematically illustrating a relationship between a driving state of the outboard motor and displacements of upper and lower mounts according to an embodiment of the invention.
Figures 9, 10:
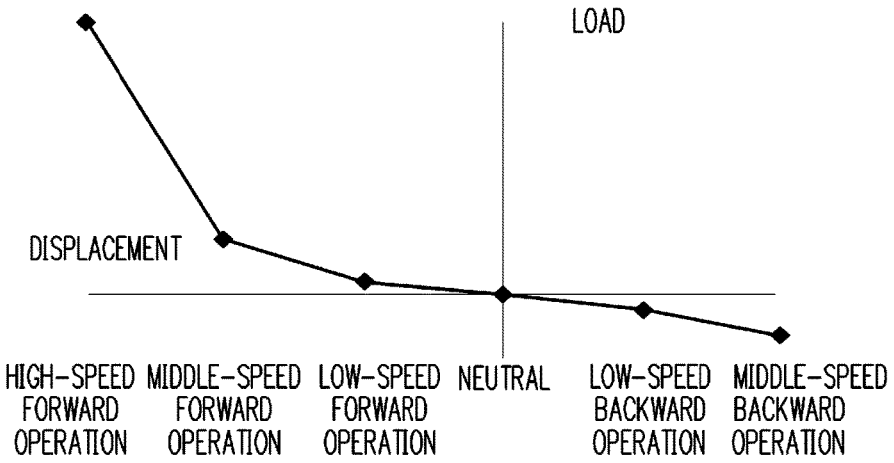
FIG. 9 is a graph illustrating a relationship between displacements and loads of the upper and lower mounts depending on the driving state of the outboard motor according to an embodiment of the invention.
FIG. 10 is a diagram illustrating a relationship between an driving state of the outboard motor and working parts of the upper and lower mounts according to an embodiment of the invention.

Next, displacements of the anti-vibration rubbers of the upper and lower mounts 23 and 24 or the like in relation to a driving state of the outboard motor will be described. FIG. 8 is a diagram schematically illustrating a relationship between the driving state of the outboard motor 10 and the displacements of the upper and lower mounts 23 and 24. FIG. 9 is a graph illustrating a relationship between the loads and displacements of the upper and lower mounts 23 and 24 depending on a driving state of the outboard motor 10.

<Neutral Operation>

(1) In the upper mount 23, the forward-side stopper 41 is provided with a clearance 42, and the backward-side stopper 43 is provided with a clearance 44. In the lower mount 24, the forward-side stopper 50 is provided with a clearance 51, and the backward-side stopper 52 is provided with a clearance 53. Therefore, in a neutral position, the outboard motor is supported by the upper and lower mounts 23 and while both the upper and lower mounts 23 and 24 have the clearances 42 and 44, and 51 and 53, respectively. As a result, it is possible to obtain an anti-vibration effect and a vibration damping effect.

<Forward Operation>

In an idling forward operation, the clearances remain, and the outboard motor 10 is supported by the upper and lower mounts 23 and 24, so that the anti-vibration effect and the vibration damping effect can be obtained. The same effects as those of the neutral operation can be obtained. Note that, in FIG. 8, void arrows denote a direction and a magnitude relationship of the propeller thrust force.

(2) In a low-speed forward operation (accelerated by slightly opening the accelerator throttle), the displacement of the lower mount 24 increases, and the clearance 51 is removed. The upper part of the outboard motor 10 is displaced backward with respect to the forward-side stopper 50 of the lower mount 24. In this state, the anti-vibration effect and the vibration damping effect are obtained by the forward-side stopper 50 and the upper mount 23.

(3) If the speed increases more (middle-speed forward operation), the propeller thrust force increases, and the clearance 42 is removed. In this state, the anti-vibration effect and the vibration damping effect are obtained by the forward-side stoppers 50 and 41.

(4) If the speed increases more (high-speed forward operation), the propeller thrust force increases, and deformation of the forward-side stoppers 50 and 41 progresses so that the anti-vibration effect and the vibration damping effect (that is, suspension effect) are obtained.

<Backward Operation>

In an idling backward operation, the clearances remain, and the outboard motor 10 is supported by the upper and lower mounts 23 and 24, so that the anti-vibration effect and the vibration damping effect can be obtained. In addition, the same effects as those of the neutral operation (1) can be obtained.

(5) In a low-speed backward operation (accelerated by slightly opening the accelerator throttle), the displacement of the lower mount 24 increases, and the clearance 53 is removed. The upper part of the outboard motor 10 is displaced forward with respect to the backward-side stopper 52 of the lower mount 24. In this state, the anti-vibration effect and the vibration damping effect are obtained by the backward-side stopper 52 and the upper mount 23.

(6) If the speed increases more (middle-speed backward operation), the propeller thrust force increases, and the clearance 44 is removed. In this state, the anti-vibration effect and the vibration damping effect are obtained by the backward-side stoppers 52 and 43.

In this case, a spring constant is different between the forward-side stopper 41 and the backward-side stopper 43 or between the forward-side stopper and the backward-side stopper 52 depending on the upper mount 23 or the lower mount 24 or depending on the forward or backward operation. FIG. 10 shows which of a plurality of stoppers in the upper and lower mounts 23 and 24 works, that is, which is the working part in relation to the driving state of the outboard motor 10.

Here, a relationship between the outboard motor type, the mount arrangement, and the anti-vibration performance will be described. First, in general, in the reciprocal engine employed in the outboard motor, an explosive force and an inertial force are generated in the cylinder axis direction. For this reason, the outboard motor is disposed such that the crankshaft is placed in a vertical direction, and the cylinder axis line is placed in the longitudinal direction. In the outboard motor, the explosive force and the inertial force are generated in the longitudinal direction, and a vibration force caused by the counterweight effect of the crankshaft to alleviate the explosive force and the inertial force is generated in the lateral direction. In addition, since a small-sized outboard motor has a smaller number of cylinders, a torque variation is generated (this dominantly works in a low-speed operation).

Therefore, in a small-sized outboard motor, if the upper mounts placed in the vicinity of the engine (also at the center of the outboard motor) are arranged in a V-shape having a proper angle and a proper position, anti-vibration (vibration damping) performance is improved.

However, in a large-sized outboard motor (in this example, a V-type six-cylinder engine), the number of cylinders is large, and a variation of the explosive force or the inertial force is insignificant due to cancellation between cylinders. Therefore, even when the V-shaped arrangement is employed, the anti-vibration (vibration damping) performance is not remarkably improved unlike a small-sized outboard motor. Meanwhile, in a large-sized outboard motor, the thrust force increases, and the speed also increases. As a result, the lifting force (rudder force) also increases. Therefore, suspension performance for alleviating variations of the thrust force and the lifting force caused by waves or a steering operation becomes important. If the lower mounts in the vicinity of the propeller or the gear casing strut (rudder portion) are arranged in a V-shape having a proper position and a proper angle, rigidity is improved. Therefore, the suspension performance of the large-sized outboard motor is improved.

If the upper mounts are arranged in a V-shape, they interfere with the exhaust passages and a coolant passage extending from the engine through the engine holder. Therefore, the upper mounts are provided over the coolant pump. If the upper mounts can be lowered in a parallel state by widening a gap, this may generate interference with a boat in a steering operation. In addition, a length of the arm from the steering shaft of the lower mount bracket to the mount increases. This degrades the strength and the rigidity of the lower mount bracket.

Meanwhile, if the upper mounts are placed directly under the engine by reducing the gap, and the lower mounts arranged in a V-shape are placed in the vicinity of the coolant pump, it is possible to increase a distance between the upper and lower mounts. If the distance between the upper and lower mounts increases, rigidity in the vertical (pitch) direction increases. Therefore, it is possible to improve suspension performance for variations of the thrust force and the rudder force.

The arrangement of the mounts described above relates to various types of performance of the outboard motor including the anti-vibration performance. FIG. 11 is a diagram illustrating a result of evaluation for a relationship between the mount arrangement and the performance of the outboard motor depending on the outboard motor type. In FIG. 11, the reference symbols "○," "Δ" and "x" denote evaluation results "excellent," "allowable," and "unallowable," respectively. Note that, in FIG. 11, the outboard motor according to the present invention corresponds to the column of the "LARGE-SIZED" having the upper mount set to "PARALLEL" and the lower mount set to "V-SHAPE."

According to the present invention, since the upper mounts 23 are arranged in parallel to each other in an in-line manner, it can be installed over the upper end of the transom board 2 (the start point of the clamp bracket 12).

According to the present invention, since the lower mounts 24 are arranged in a V-shape, it is possible to lower the lower mounts 24 to the position of the coolant pump 54 without reducing the strength of the lower mount bracket 35 and generating interference between the ship hull (boat 1) and the lower mount bracket 35.

According to the present invention, it is possible to increase the distance between the upper and lower mounts 23 and 24. Therefore, it is possible to improve rigidity in the vertical direction and the suspension performance.

In the mount arrangement of FIG. 11, it is assumed that a pair of mounts are arranged in the vicinity of the center of the outboard motor, and a pair of mounts are arranged in the left and right sides in the vicinity of the clamp bracket.

In a small-sized outboard motor, an operator directly performs steering using a tiller handle. In a large-sized outboard motor, the outboard motor is indirectly controlled by an operator who seats on the cabin on a mechanical or hydraulic basis.

With regard to the anti-vibration, in most of the outboard motors, the crankshaft of the outboard motor is arranged in a vertical direction, and the engine receives an inertial force (in the longitudinal direction) and a couple force (in the longitudinal and lateral directions). The magnitude and the direction of the inertial force or the couple force can be changed using a counterweight or a balance weight of the crankshaft. The remaining engine vibration forces include a vertical direction (traveling direction) and a horizontal direction (perpendicular to the traveling direction). If the number of cylinders is small, a torque variation component becomes dominant in the vibration force.

With regard to the thrust force, the thrust force is generated from the propeller in the traveling direction. A variation of the rotation of the engine generates a variation of the thrust force. The thrust force also varies when the propeller blades are emerged from the water surface, or the distance of the strut is changed periodically.

With regard to the horizontal force (rudder lifting force), if the outboard motor is steered, a horizontal force is generated because a strut bracket has an elevation angle against a flow. In addition, because the propeller is steered by itself, the thrust force is a combinational force between the forward driving force and the horizontal force.

As described above, the lower mount 24 serving as a lower anti-vibration mount receives the thrust force and the steering reaction force of the propeller 17. Therefore, relative to the upper mount serving as an upper anti-vibration mount, the lower mount 24 receives a larger thrust load, and the lower mount bracket that supports the lower mount 24 is necessary to have a larger size in order to obtain higher strength and rigidity. Since the lower anti-vibration mount is arranged in a V-shape, it is possible to reduce a length of the arm of the lower mount bracket 35. Therefore, a bending moment exerted to this lower mount bracket 35 is reduced, so that it is possible to reduce necessary strength and rigidity and reduce the size of the lower mount bracket. Meanwhile, if the upper mount 23 is arranged in the V-shape, the axial lines of the anti-vibration mounts are not in parallel to each other. Therefore, it is difficult to assemble the upper mount 23 to the steering bracket 29 serving as an upper mount bracket while the anti-vibration mount is sub-assembled to the middle unit 15. This increases the assembly time and the cost. Relative to the lower mount 24, the upper mount 23 receives a smaller thrust load. Therefore, even when the upper mounts are arranged in a parallel shape, it is not necessary to increase the size of the upper mount bracket to increase strength and rigidity. Therefore, it is possible to reduce the cost necessary in the assembly work.

Since the lower mount 24 serving as a lower anti-vibration mount can be arranged in the vicinity of a load center of the propeller 17 and the rudder, a moment load applied to the lower mount 24 is reduced, and a support span with the upper mount 23 is widened, so that the support rigidity increases. This contributes to improvement of maneuvering stability.

Furthermore, since the upper mount 23 is arranged directly under the V-type four-cycle engine by avoiding the left and right exhaust passages 21, a distance between the upper mount 23 and the V-type four-cycle engine is reduced. Therefore, it is possible to improve anti-vibration performance and widen the support span with the lower mount 24 to improve support rigidity. This contributes to improvement of maneuvering stability.

While embodiments of the present invention have been described in details with reference to the accompanying drawings hereinbefore, they are just for illustrative purposes for showing specific examples of the present invention. A technical scope of the present invention is not limited to the embodiments described above. Various changes and modifications may also be possible with departing from the scope and spirit of the present invention, and they are also intended to encompass the scope of the present invention.

For example, although the outboard motor has contra-rotating propellers in the aforementioned embodiments, the present invention may also be effectively applied to an outboard motor having a single propeller. Even in this case, the same functional effects as those of the aforementioned embodiments can be obtained.

According to the present invention, the lower anti-vibration mounts are arranged in a V-shape. Therefore, a bending moment applied to the lower mount bracket can be reduced, so that strength and rigidity can be reduced. This makes it possible to reduce the size. The upper anti-vibration mounts are arranged in a parallel manner. Therefore, the upper anti-vibration mounts can be formed in a large size, and it is not necessary to increase strength and rigidity. Therefore, it is possible to reduce cost for the assembly work.

What is claimed is:

1. An outboard motor comprising:

a clamp bracket fixedly installed in a rear part of a ship hull;

a swivel bracket provided with a support shaft extending in a vertical direction and supported by the clamp bracket;

an outboard motor body installed in the swivel bracket swingably with respect to the support shaft; and a pair of left and right anti-vibration mounts provided with an outer tube interposed between the swivel bracket and the outboard motor body, an inner tube loosely fitted to the outer tube, and a shock-absorbing material interposed between the outer and inner tubes, wherein the pair of left and right anti-vibration mounts are each arranged in an upper part of the swivel bracket over the clamp bracket and a transom board of the ship hull and in a lower part of the swivel bracket vertically overlapping with the transom board of the ship hull under the clamp bracket, the upper pair of left and right anti-vibration mounts have axial lines arranged in parallel with a longitudinal center line extending in a longitudinal direction of the outboard motor body, and the lower pair of left and right anti-vibration mounts have axial lines concentrated on one point on the longitudinal center line extending in the longitudinal direction of the outboard motor body and inclined at an identical angle symmetrically with respect to the longitudinal center line such that the axial lines intersect in a V-shape in front of the support shaft as seen in a plan view of the outboard motor body.

2. The outboard motor according to claim 1, wherein the outboard motor body includes:

an upper engine, a middle unit placed under the engine and provided with the upper and lower anti-vibration mounts, and a lower unit that rotatably supports a propeller, the middle unit includes:

a drive shaft that vertically extends to transmit power of the engine to the propeller;

a coolant pump provided in a lower end having a coupling portion coupled to the lower unit and driven by the drive shaft; and an exhaust passage provided inside of the middle unit to allow an exhaust gas of the engine to pass therethrough, wherein the lower anti-vibration mounts have axial lines overlapping with the coolant pump in the lower end of the middle unit as seen in a side view of the outboard motor body.

3. The outboard motor according to claim 1, wherein the engine of the outboard motor body is a V-type four-cycle engine including a crankshaft extending in a vertical direction, a left bank extending to a left side with a backward inclination, and a right bank extending to a right side with a backward inclination, exhaust passages each communicating with combustion chambers of the left and right banks communicate with exhaust passages provided in the middle unit through outer sides of the left and right banks in a width direction of the outboard motor, the exhaust passages inside the middle unit include left and right exhaust passages communicating with the exhaust passages of the left and right banks, respectively, and the upper anti-vibration mounts are disposed between the left and right exhaust passages.

4. The outboard motor according to claim 2, wherein the engine of the outboard motor body is a V-type four-cycle engine including a crankshaft extending in a vertical direction, a left bank extending to a left side with a backward inclination, and a right bank extending to a right side with a backward inclination, exhaust passages each communicating with combustion chambers of the left and right banks communicate with exhaust passages provided in the middle unit through outer sides of the left and right banks in a width direction of the outboard motor, the exhaust passages inside the middle unit include left and right exhaust passages communicating with the exhaust passages of the left and right banks, respectively, and the upper anti-vibration mounts are disposed between the left and right exhaust passages.

* * * * *